United States Patent [19]

Sherman

[11] Patent Number: 4,689,906

[45] Date of Patent: Sep. 1, 1987

[54] DISPLAY FRAME FOR MOUNTING VERTICAL SURFACE

[75] Inventor: Charles F. Sherman, Townsend, Mass.

[73] Assignee: Esselte Pendaflex Corp., Garden City, N.Y.

[21] Appl. No.: 767,802

[22] Filed: Aug. 21, 1985

[51] Int. Cl.[4] ..... A47G 1/06; G09F 1/12

[52] U.S. Cl. ..... 40/152.1; 248/295.1; 248/496; 248/495

[58] Field of Search ..... 40/152.1, 152, 155, 40/156; 248/489, 490, 491, 492, 493, 495, 496, 497, 295.1; 403/295

[56] References Cited

U.S. PATENT DOCUMENTS

| | | | |
|---|---|---|---|
| 730,141 | 6/1903 | Matthews | 248/495 |
| 2,654,451 | 10/1953 | Schmidgall | 403/295 |
| 2,820,311 | 1/1958 | Hamlin | 248/497 |
| 2,905,412 | 9/1959 | Kipp | 248/495 |
| 3,668,799 | 6/1972 | Sharron | 40/152.1 |
| 3,899,844 | 8/1975 | Munn | 40/156 |
| 3,922,807 | 12/1975 | Shore | 40/152.1 |
| 4,014,119 | 3/1977 | Teufel | 40/156 |
| 4,348,826 | 9/1982 | Reim | 40/156 |
| 4,368,584 | 1/1983 | Logan | 40/152 |
| 4,420,138 | 12/1983 | Sobel | 248/496 |
| 4,547,986 | 10/1985 | Sherman | 40/155 |

FOREIGN PATENT DOCUMENTS

| | | | |
|---|---|---|---|
| 2400187 | 10/1974 | Fed. Rep. of Germany | 248/495 |

*Primary Examiner*—Gene Mancene
*Assistant Examiner*—J. Hakomaki
*Attorney, Agent, or Firm*—Darby & Darby

[57] ABSTRACT

A structure for displaying articles on vertical surfaces. Included in the structure is a frame assembly for retaining the display article and a pair of frame hangers retained by the frame assembly and adapted to receive the ends of a supporting strand. The frame assembly comprises a plurality of joined elongated frame sections; each frame section comprising a longitudinally extending channel defined by a rear wall, a pair of side walls joined to the rear wall, and a pair of front wall lips each having one edge joined to a different one of the side walls and opposite edges spaced apart by a slot that opens into the channel. Each frame hanger is retained by a channel of a different frame section and comprises a latch arm portion extending into a portion of the channel defined by the rear wall, one of the side walls and one of the front wall lips, an inner end of the latch arm portion engaging the rear wall; a base portion having one end projecting out of the channel through the slot and joined to the latch arm portion, the one end engaging the opposite edge of the one front wall lip and the base portion defining a tapped hole; a lever portion extending from an end of the base portion opposite to the one end and defining an engagement surface; a fastener having a head and a threaded shank received by the tapped hole, the head comprising first and second diametrically opposed contact surfaces, the first contact surface engaging the engagement surface and the second contact surface engaging an outer surface of the one side wall; and a retainer adapted to retain one end of a frame supporting strand.

10 Claims, 4 Drawing Figures

DISPLAY FRAME FOR MOUNTING VERTICAL SURFACE

BACKGROUND OF THE INVENTION

This invention relates generally to a display frame and, more particularly, to a combination frame and hanger assembly that can be supported on a vertical surface.

There exist many types of frame structures for mounting displays on a vertical surface. The frames generally are hung from either a nail or screw embedded in the vertical support surface. Typical mounting structures include either wires or cords having ends attached to rear surfaces of the frame's vertical side sections or serrated brackets secured to the rear surface of the frame's upper frame section. Some mounting structures are specifically suited for use with frame section extrusions having longitudinally extending open channels. Examples of such mounting elements are disclosed in U.S. Pat. No. 2,581,843 and in U.S. application Ser. No. 639,132 now U.S. Pat. No. 4,571,866 assigned to the assignee of this application.

Prior frame mounting elements suffer from a number of disadvantages including relatively high cost, difficult assembly requirements, inadequate support strength, etc. Also, some mounting elements such as that disclosed in above noted U.S. application Ser. No. 639,132 are limited for use only with frame sections having rearwardly opening channels. Such elements cannot be used with rear loading frames composed of extrusions having side opening channels.

The object of this invention, therefore, is to provide an improved frame assembly for mounting on vertical surfaces.

SUMMARY OF THE INVENTION

The invention is a structure for displaying articles on vertical surfaces. Included in the structure is a frame assembly for retaining the display article and a pair of frame hangers retained by the frame assembly and adapted to receive the ends of a supporting strand. The frame assembly comprises a plurality of joined elongated frame sections; each frame section comprising a longitudinally extending channel defined by a rear wall, a pair of side walls joined to the rear wall, and a pair of front wall lips each having one edge joined to a different one of the side walls and opposite edges spaced apart by a slot that opens into the channel. Each frame hanger is retained by a channel of a different frame section and comprises a latch arm portion extending into a portion of the channel defined by the rear wall, one of the side walls and one of the front wall lips, an inner end of the latch arm portion engaging the rear wall; a base portion having one end projecting out of the channel through the slot and joined to the latch arm portion, the one end engaging the opposite edge of the one front wall lip and the base portion defining a tapped hole; a lever portion extending from an end of the base portion opposite to the one end and defining an engagement surface; a fastener having a head and a threaded shank received by the tapped hole, the head comprising first and second diametrically opposed contact surfaces, the first contact surface engaging the engagement surface and the second contact surface engaging an outer surface of the one side wall; and a retainer adapted to retain one end of a frame supporting strand. The fasteners securely retain the hangers in the frame section channels and the retainer provides support for a strand which can be used to hang the frame assembly.

According to one feature of the invention, the second contact surface is spaced from the one end of the base portion in a direction parallel to the latch arm portion by a distance greater than the length thereof projecting into the channel portion. This spacing accommodates the one side wall forming the channel portion that receives the latch arm.

According to another feature of the invention, the base portion comprises a flat surface that defines the tapped opening, and the lever portion comprises an outer portion substantially parallel to the flat surface and a connecting portion extending between the base portion and the outer portion in a direction parallel to the latch arm. This arrangement simplifies the hanger structure while facilitating its desired function.

According to still another feature of the invention, the base portion defines a transverse groove in the flat surface and extending the full width thereof, the bottom of the transverse groove defining a portion of the one end of the base portion from which the distance to the engagement surface is measured. The transverse groove functions to more securely retain the front wall lip of the frame section.

According to yet another feature of the invention, the first and second contact surfaces comprise a conical portion of the head, and the engagement surface comprises a sloped surface portion of the connecting portion with a slope corresponding to the slope of the conical portion. This arrangement enhances the retaining characteristics of the hangers.

According to other features of the invention, the retainer comprises a retainer opening in the outer portion of the lever portion, and the shank of the fastener is substantially orthogonal to the flat surface. These features simplify both assembly of the hangers and securement of the support strand.

According to a further feature of the invention, each of the frame sections comprises a rim portion for bordering an item to be displayed by the frame assembly, the rim portion being substantially parallel to the base portion and extending from the one edge of the front wall lip other than the one front wall lip engaged by the hanger base portion. This arrangement provides a frame assembly suitable for rear loading.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
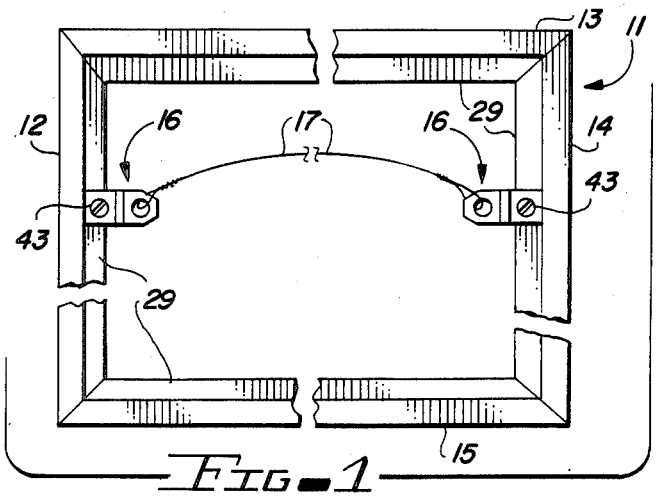
FIG. 1 is a schematic rear view of a frame assembly according to the invention.

Illustrated in FIG. 1 is a frame assembly 11 for accommodating an item to be displayed on a vertical wall surface. The frame assembly 11 includes four frame sections 12–15 having mitered ends joined to form a rectangularly shaped enclosure. Mounted in vertically aligned positions on each of the side frame sections 12, 14 is a frame hanger 16. A strand 17 of wire or string extends between the hangers 16 and can be used to hang the assembly 11 on a nail or the like inserted into a vertical wall surface (not shown).

Figure 4:
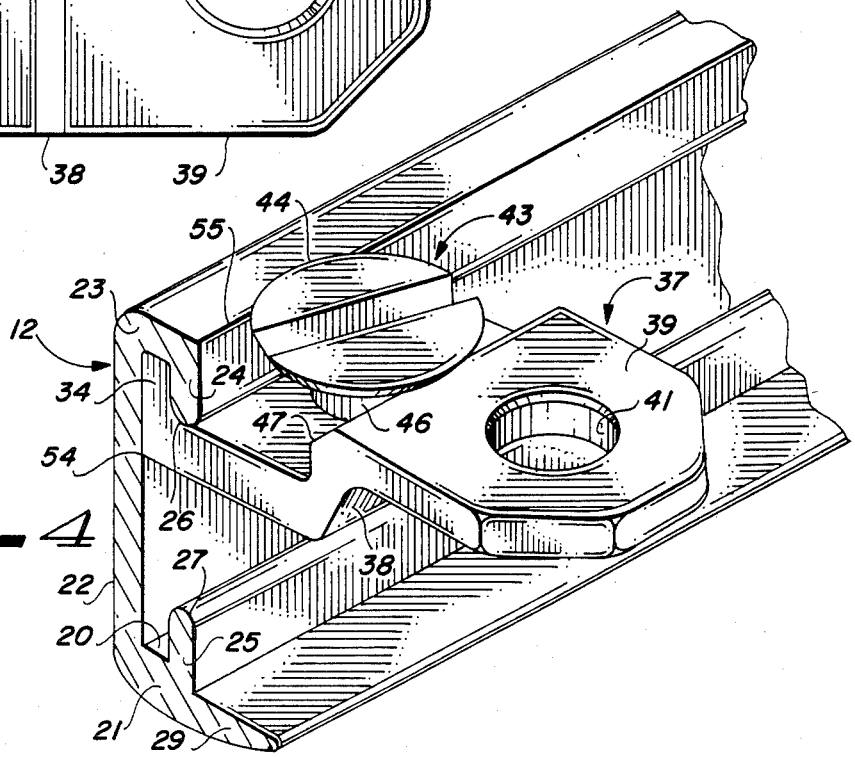
FIG. 4 is a schematic perspective view of a portion of the frame assembly shown in FIG. 1.

All of the frame sections 12–15 are identical and a clear depiction of the frame section 12 is shown in FIG. 4. The frame section 12 has a longitudinally oriented channel 20 defined by a rear wall 22 side walls 21, 23 and front wall lips 24, 25. Each of the side walls 23, 24 join a different edge of the rear wall 22 to, respectively, one edge of the front wall lips 24 and 25. The opposite edges 26, 27 of the lips 24 and 25 are spaced apart by a slot 28 that opens into the channel 20. Extending transversely from each of the sections 12–15 is a rim portion 29 joined to an inner edge of the front wall lip 25.

Figure 2:
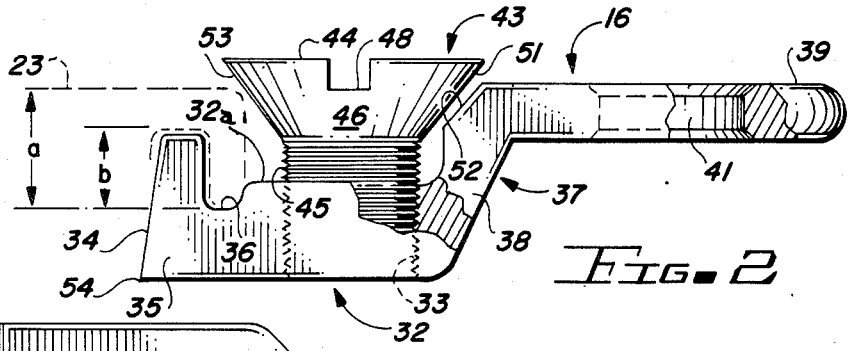
FIG. 2 is a schematic side view of a frame hanger shown in FIG. 1.
Figure 3:
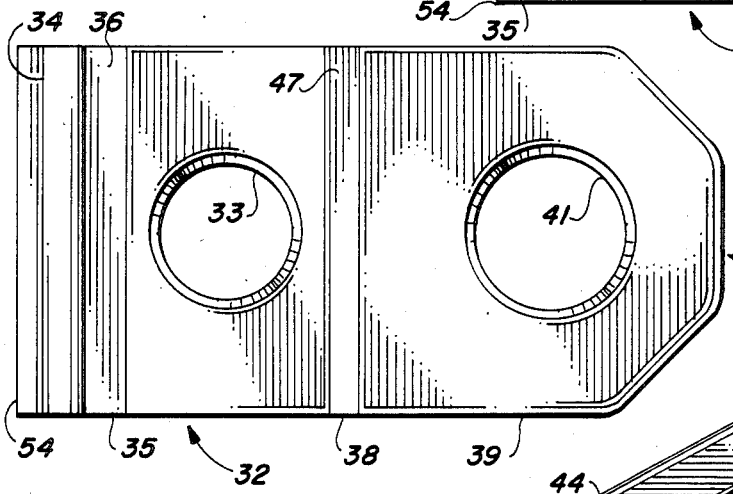
FIG. 3 is a schematic top view of the frame hanger shown in FIG. 2 with a screw removed.

As shown in FIGS. 2 and 3, the hanger 16 includes a base portion 32 having a flat surface 32*a* into which opens a tapped hole 33. A latch arm portion 34 is joined to one end 35 of the base portion 32 and extends orthogonally to the surface 32*a*. Reducing the thickness of the base portion end 35 is a transverse groove 36 that extends the full width of the surface 32*a*. A lever portion 37 is joined to an opposite end of the base portion 32 and includes a connecting portion 38 that slopes away from the surface 32*a* in the same sense as does the latch arm 34 and an outer portion 39 that is parallel to the flat surface 32*a*. Extending through the outer lever portion 39 is an opening 41 that receives an end of the strand 17 shown in FIG. 1.

Also part of the hanger 16 is a fastener screw 43 having a head 44 and a threaded shank 45 that is received by the tapped hole 33 in the base portion 31. A conically shaped portion 46 of the head 44 is mated to an adjacent sloping surface 47 of the connecting portion 38 of the lever 37. Formed in the outer surface of the head 44 is a slot 48 that accommodates a suitable tool such as a screwdriver.

Prior to mounting of the hanger 16 in the frame section 12, the screw 43 is backed off to the position shown in FIG. 2 with the conical surface 46 separated from the sloping surface 47. The latch arm portion 34 of the hanger 16 then is inserted into that portion of the channel 20. defined by the rear wall 22, the side wall 23, and the front wall lip 24 as shown in FIG. 4. After positioning of the hanger 16, the screw 43 is advanced to the position also shown in FIG. 4 wherein a first contact surface 51 of the conically shaped head surface 46 engages an engagement surface 52 on the sloped connector surface 47. In that position also, a second contact surface 53 of the conically shaped head surface 46 engages an outer edge surface 55 of the side wall 23.

Tightening of the screw 43 induces a force on the lever portion 37 that moves the lower end 54 of the latch arm 34 into forcible engagement with the rear wall 22 of the frame section 12. The screw 43 also exerts, via the contact surface 53, a force on the outer edge 55 of the side wall 23 that moves the outer edge 26 of the front wall lip 24 into forcible engagement with the bottom surface of the groove 36. As indicated by FIG. 2 with the first contact surface 51 engaging the engagement surface 52, the second contact surface 53 is spaced from the bottom of the groove 36 in a direction perpendicular to the flat surface 32*a* by a distance a that is substantially greater than the projection b therefrom of the latch arm 34. That additional spacing accommodates the side wall 23. The second contact surface 53 and the engagement surface 52 also extend above the bottom of the groove 36 by the distance substantially greater than the projected length b of the latch arm 34. That arrangement facilitates the simultaneous engagement of the surfaces 51 and 52 and the surfaces 53 and 55 by the screw 43 having a shaft 45 oriented orthogonally to the base portion 31. Forcible engagement between the lower end 54 of the latch arm 34 and the rear wall 22 and between the lip edge 26 and the hanger groove 36 securely retains the hanger 36 in position within the channel 20. In addition, increased contact area provided by the mating surfaces 51 and 52 improves the holding strength of the mounted hanger. After another hanger 16 is similarly mounted in the frame section 14, a strand 17 can be secured to the retainer openings 41 and used to support the frame assembly 11 from a wall surface (not shown).

Obviously, many modifications and variations of the present invention are possible in light of the above teachings. It is to be understood, therefore, that the invention can be practiced otherwise than as specifically described.

What is claimed is:

1. Article display apparatus comprising:

a frame assembly comprising a plurality of joined elongated frame sections; each frame section comprising a longitudinally extending channel defined by a rear wall, a pair of side walls joined to said rear wall, and a pair of front wall lips each having one edge joined to a different one of said side walls and opposite edges spaced apart by a slot that opens into said channel; and a pair of frame hangers each retained by a channel in a different one of said frame sections; each of said hangers comprising a latch arm portion extending into a portion of said channel defined by said rear wall, one of said side walls and one of said front wall lips, an inner end of said latch arm portion engaging said rear wall; a base portion having one end projecting out of said channel through said slot and joined to said latch arm portion, said one end engaging said opposite edge of said one front wall lip and said base portion defining a tapped hole; a lever portion extending from an end of said base portion opposite to said one end and defining an engagement surface; a fastener having a head and a threaded shank received by said tapped hole, said head comprising first and second diametrically opposed contact surfaces, said first contact surface engaging said engagement surface and said second contact surface engaging an outer surface of said one side wall; and retainer means adapted to retain one end of a frame supporting strand.

2. An apparatus according to claim 1 wherein said second contact surface is spaced from said one end of said base portion in a direction parallel to said latch arm portion by a distance greater than the length thereof projecting into said channel portion.

3. An apparatus according to claim 2 wherein said base portion comprises a flat surface that defines said tapped opening, and said lever portion comprises an outer portion substantially parallel to said flat surface and a connecting portion extending in said direction between said base portion and said outer portion.

4. An apparatus according to claim 3 wherein said base portion defines a transverse groove in said flat surface and extending the full width thereof, the bottom of said transverse groove defining a portion of said one end of said base portion from which said distance is measured.

5. An apparatus according to claim 3 wherein said first and second contact surfaces comprise a conical portion of said head, and said engagement surface comprises a sloped surface portion of said connecting portion with a slope corresponding to the slope of said conical portion.

6. An apparatus according to claim 5 wherein said base portion defines a transverse groove in said flat surface and extending the full width thereof, the bottom of said transverse groove defining a portion of said one end of said base portion from which said distance is measured.

7. An apparatus according to claim 6 wherein said retainer means comprises a retainer opening in said outer portion of said lever portion.

8. An apparatus according to claim 6 wherein said shank is substantially orthogonal to said flat surface.

9. An apparatus according to claim 6 wherein said latch arm portion extends substantially orthogonally to said flat surface.

10. An apparatus according to claim 6 wherein each of said frame sections comprises a rim portion for bordering an item to be displayed by said frame assembly, said rim portion being substantially parallel to said base portion and extending from said one edge of said front wall lip other than said one front wall lip.

* * * * *